US009301065B2

(12) United States Patent
Karamuk et al.

(10) Patent No.: US 9,301,065 B2
(45) Date of Patent: Mar. 29, 2016

(54) MICROPHONE BATTERY BARRIER

(71) Applicant: Phonak AG, Staefa (CH)

(72) Inventors: Erdal Karamuk, Männedorf (CH); Andi Vonlanthen, Oberrohrdorf (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 14/443,646

(22) PCT Filed: Jan. 17, 2013

(86) PCT No.: PCT/EP2013/050853

§ 371 (c)(1),
(2) Date: May 18, 2015

(87) PCT Pub. No.: WO2014/111146

PCT Pub. Date: Jul. 24, 2014

(65) Prior Publication Data

US 2015/0312688 A1 Oct. 29, 2015

(51) Int. Cl.

| | |
|---|---|
| ***H04R 25/00*** | (2006.01) |
| ***H04R 1/10*** | (2006.01) |
| *H04R 1/08* | (2006.01) |

(52) U.S. Cl.

CPC ..... *H04R 25/65* (2013.01); *H04R 1/1058* (2013.01); *H04R 25/654* (2013.01); *H04R 1/086* (2013.01); *H04R 25/602* (2013.01)

(58) Field of Classification Search

CPC ..... H01M 2/12; H01M 2/34; H01M 2/043; H01M 2/348; H01M 6/08; H01M 4/86; H01M 4/90; H01M 4/98; H01M 10/48; H01M 10/425; H01M 10/4214; B29C 65/08; B29C 66/30223; H04R 25/60; H04R 25/65; H04R 25/602; H04R 25/604; H04R 25/566; H04R 25/652; H04R 25/658; H04R 25/456; H04R 2225/03; H04R 2225/31; H04R 2225/61

USPC ..... 381/322, 323, 328; 429/4, 7, 27, 82; 324/432

See application file for complete search history.

(56) References Cited

U.S. PATENT DOCUMENTS

| | | | |
|---|---|---|---|
| 6,058,198 | A | 5/2000 | Aceti et al. |
| 7,298,857 | B2 | 11/2007 | Shennib et al. |
| 7,313,245 | B1 | 12/2007 | Shennib |
| 7,379,555 | B2 | 5/2008 | Gable et al. |
| 7,751,579 | B2 | 7/2010 | Schulein et al. |
| 2006/0050914 | A1 | 3/2006 | Urso et al. |

(Continued)

FOREIGN PATENT DOCUMENTS

| | | | |
|---|---|---|---|
| CA | 2 412 476 | A1 | 12/2002 |
| EP | 1287721 | B1 | 7/2005 |
| WO | WO 2010/148406 | A1 | 12/2010 |

OTHER PUBLICATIONS

PCT Search Report dated Mar. 19, 2013 for PCT App. Ser. No. PCT/EP2013/050853.

*Primary Examiner* — Brian Ensey

(74) *Attorney, Agent, or Firm* — Henricks, Slavin & Holmes LLP

(57) ABSTRACT

A hearing device comprising a battery compartment including a metal-air battery and a microphone assembly arranged nearby or coupled to the battery compartment, the battery compartment and/or the microphone assembly in protected using an elastic polymer membrane.

12 Claims, 1 Drawing Sheet

(56) References Cited

U.S. PATENT DOCUMENTS

Figure 1:
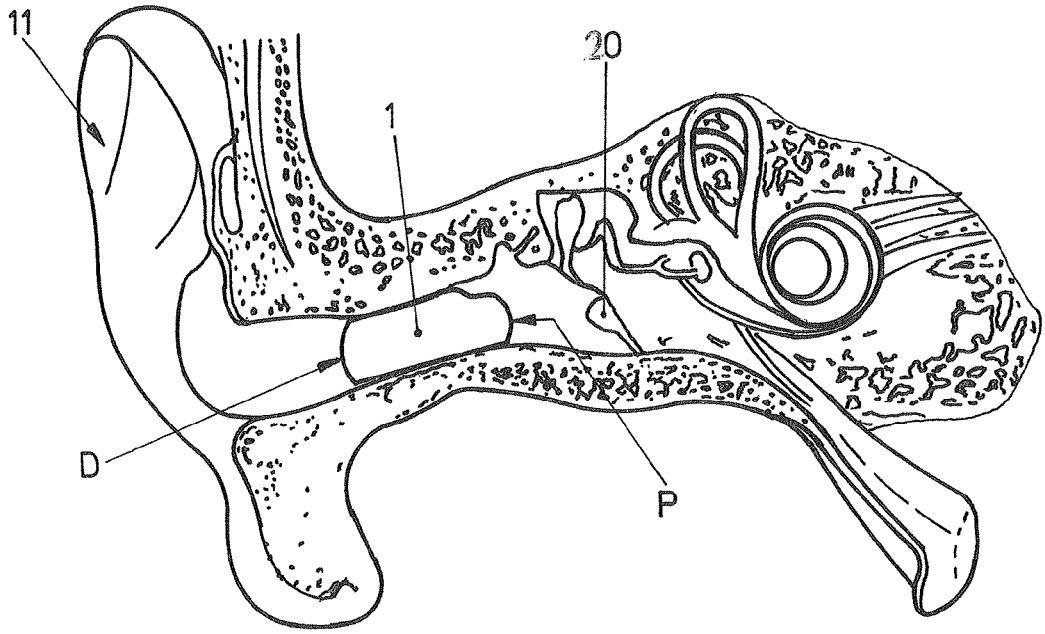

2007/0003084 A1 1/2007 Huynh et al.
2008/0031482 A1 2/2008 Day et al.
2008/0069386 A1 3/2008 Gable et al.
2010/0322452 A1* 12/2010 Ladabaum ..... H04R 25/656
381/375
2011/0027665 A1 2/2011 Burchardt et al.

* cited by examiner

MICROPHONE BATTERY BARRIER

CROSS-REFERENCE TO RELATED APPLICATIONS

This application is the U.S. National Stage of PCT App. Ser. No. PCT/EP2013/050853, filed Jan. 17, 2013.

The present invention refers to a hearing device comprising a battery compartment including a metal-air battery and a microphone assembly arranged nearby or coupled to the battery compartment.

In particular the invention relates to the combination of a microphone protection membrane (MPM) and a gas diffusion barrier (GDB), especially for extended wear applications of hearing aids. In such an application, the hearing aid is placed deep into the ear canal of a patient (~4 mm to the TM) and can remain there for a period of several weeks or even months without the need of taking out the device. In order to last over such a long period with only one single battery these devices are optimized for minimal power requirements.

The background of the invention is in the design of choked metal-air batteries for extended wear hearing aid applications. The problems and challenges of such batteries are well explained in U.S. Pat. No. 7,379,555. A key element of such a choked battery design is the ability to regulate the transport of oxygen (air) into the battery and of moisture in and out of the battery. While the first one is responsible for the limiting current, the second influences the composition of the electrolyte.

Various solutions are implemented and described that allow the regulation of such a gas diffusion control element:

- U.S. Pat. No. 7,379,555 describes a flow limiting polymer membrane that has either laser-drilled holes of 10 to 15 μm or comprises compressed and uncompressed regions.
- U.S. Pat. Pub. No. 2008/0069386 describes a flow limiting polymer membrane that has laser-drilled-micro-holes of 10 to 15 μm and specifies material and thickness and tolerances.
- U.S. Pat. No. 5,306,578 describes designs for an air cell with a gas diffusion electrode that is made by impregnating an air diffusion porous sheet with film-forming silicone.

In general the existing solutions are based on either compressing a porous polymer membrane or to drill high precision micro-holes in a non-permeable polymer membrane using YAG or Eximer lasers. Both solutions although technically feasible—have significant disadvantages with regard to a high volume product such a single use metal-air battery for a hearing aid.

The following list below gives a summary on some prominent applications:

- U.S. Pat. No. 7,751,579 publication describes the use of a protective barrier for sound inlets and outlets of acoustic devices based on a thin film that is attached onto the sound port.
- EP 1287721 B1 describes an in-the-ear hearing device with an electric/acoustic transducer arrangement, the acoustic output of the transducer being separated from the surroundings by means of a membrane having a rubber-like elasticity.

There are also some publications dealing with the arrangement of battery venting and microphone protection:

- U.S. Pat. No. 7,298,857 describes a common air cavity for microphone and battery in a CIC device. The soundport faces a medial direction with respect to the canal. The positioning of the microphone assembly defines an air cavity disposed between the microphone assembly and the battery assembly with the port and the vent fluidically coupled to the cavity.
- U.S. Pat. No. 7,313,245 describes an acoustically transparent intracanal cap that is placed laterally to the hearing instrument in to the canal for shielding the device from water and cerumen. Acoustic transparency and air flow is achieved by a porous membrane as part of the cap.
- WO 2010/148406 A1 describes a combination of tubular structures and porous sound inlets to prevent the ingress of liquid or oil into an extended wear hearing device.

The problem of all the above mentioned solutions is, that hearing devices for extended wear need two elements to ensure their specified longevity:

1. Microphone protection that prevents the ingress of moisture, cerumen and debris into the microphone. As the device is resting in the ear canal over several months, the microphone protection must provide effective shielding against moisture and liquids.
2. Gas diffusion barrier that limits the amount of air and oxygen reaching the battery and controls the humidity into and out of the battery.

On the other hand, size and manufacturing cost are very critical for the business success of extended wear hearing instruments:

Size must be minimized in order to increase the fit rate. Reducing the number of components and further integration as intended by the present invention are necessary steps. Integration and combination of functions (microphone barrier and gas diffusion barrier) are steps towards reduction of manufacturing costs, since process steps and tests can be omitted.

On object of the present invention therefore is, to propose the possibility to have a microphone protection that prevents the ingress of moisture, etc. as mentioned above and which guarantees a limited amount of air and oxygen reaching the battery and controls the humidity in the sense of a gas diffusion battery into and out of the battery.

As a consequence, the present invention proposes a hearing device according to the wording of claim 1.

The fundamental idea of the present invention is to protect the microphone of an extended wear hearing device with a membrane that is acoustically transparent and also has sufficient oxygen permeability to act as a gas diffusion membrane.

The present invention proposes the use of an elastic polymer membrane as microphone screen and/or gas diffusion barrier membrane of the battery compartment. The membrane separates a volume that is defined by the microphone inlet and/or the battery vent from the surroundings. The sound inlet into the hearing instrument might still be protected from cerumen by e.g. a silicon tube.

The basic feasibility of the proposed concept has already been demonstrated for membranes of injection molded silicone rubber where it was shown that 1) it is possible to manufacture injection molded silicone rubber membranes of less than 20 μm thickness, and
2) a silicon rubber membrane can be utilized a gas diffusion barrier for a primary zinc-air battery (Lyric battery) leading to limiting currents of 150 uA to 300 uA depending on membrane thickness.

Experiments with injection molded silicone rubber GDB show a clear dependence of battery limiting (IL) current with membrane thickness. To reach the target of 155 uA to 300 uA it has been recognized that a particular geometry of a membrane thickness of <40 μm would be sufficient.

The main idea of the current invention consist of replacing the porous microphone protection grid as known in the state of the art with a thin membrane-based protection element, that can be e.g. injection molded or assembled by attaching a thin film onto a carrier ring. It is known that a membrane of <20 um thickness and ~3 mm diameter is suitable for this purpose. As a special geometry of an extended wear hearing device does not allow for a circular cross-section the microphone protection membrane has to be more e.g. elliptic in shape.

The right choice of material allows enough oxygen permeability to ensure a stable limiting current for the battery. The table below shows that any other material than silicone rubber is likely to fail for this application. A low-density polyethylene membrane for example as it is used in a state of the art product will have a ~70× lower oxygen permeability than silicone rubber of the same thickness.

TABLE 1

Oxygen permeability of silicone rubber[9]

| Polymer | Permeability * $10^9$, $cm^3$ * cm/ (s * $cm^2$ * cmHg) |
|---|---|
| Dimethylsilicone rubber | 60.0 |
| Fluorosilicone | 11.0 |
| Nitrile rubber | 8.5 |
| Natural rubber | 2.4 |
| Polyethylene, low density | 0.8 |
| Butyl rubber | 0.14 |
| Polystyrene | 0.12 |
| Polyethylene, high density | 0.10 |
| Nylon 6 | 0.004 |
| Poly(ethylene terephthalate) | 0.0019 |
| "Teflon" | 0.00041. |

In summary the invention claims the usage of a membrane such as potentially non-circular membrane made out of silicone rubber that is used as a microphone protection and gas diffusion barrier at the same time. By tuning the design parameters such as thickness, uniformity, area and the material parameters such as type, hardness, filler, processing, the acoustic performance and the gas permeability can be balanced.

The invention shall be described in more details with reference to the attached drawings showing particular examples without being limited thereto.

Figure 2:
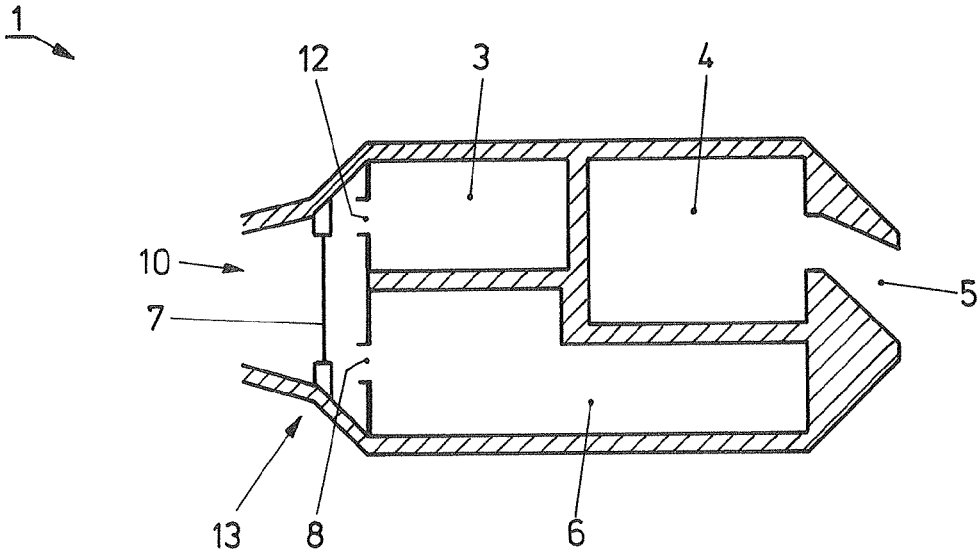

FIG. 1 is a depiction of a human hear canal showing a placement of a completely in the canal embodiment hearing device according to the present invention, and FIG. 2 is showing a schematic drawing in longitudinal section of a hearing device according to the present invention.

As shown in FIG. 1, a hearing device 1 according to the present invention can be placed in the ear canal with an end (P) facing the tympanic membrane 20 and an end (D) facing the auricle 11 of a patient. In this specific example, the hearing device 1 is a completely in the canal hearing device 1. In this particular example, the hearing device 1 is placed inside the ear canal for an extended period of time, i.e. without having to be removed for a particular time interval by the patient. Such hearing devices are also known as extend wear hearing aids. Such devices are not surgically placed and are worn for time intervals ranging from a couple of weeks up to months, particularly of from 1 to 5 months without removal.

FIG. 2 shows a hearing device 1 according to the present invention in a schematic cross-sectional view. The hearing device 1 has an end for facing the tympanic membrane (not shown in FIG. 2) of a patient and an end for facing the entrance of the ear canal or the auricle of a patient respectively (not shown in FIG. 2). The hearing device 1 has an opening 10, which is provided with a silicone membrane that functions as a baffle towards the tympanic membrane. As such, it function as a primary barrier against contamination of the inside of the hearing device 1 with material from the inside of the ear canal, such as cerumen and humidity. The hearing device 1 further has a transducer and microphone compartment and an inlet opening 12 for receiving sound waves from the outside, particularly from entrance of the ear canal. The hearing device 1 further comprises a battery compartment 6 with an air metal battery, such as e.g. a zinc-air battery 6. The compartment of the air-metal battery 6 opens toward the opening 10 of the hearing device 1 with a battery vent 8. The hearing device 1 further has an opening sound outlet 5 facing the end opening towards the tympanic membrane. Both, the battery vent 8 and the inlet 12 for receiving sound waves are arranged such as to face the opening 10, in which the elastic polymer membrane such as the silicon membrane is arranged. The membrane 7 separates the volume that is defined by the microphone inlet and the battery vent from the surroundings. The sound inlet 10 into hearing instrument might still be protected from cerumen by a silicon tube 13. In addition, both, the battery vent 8 and the inlet 12 for the sound waves, face the semi-permeable membrane 7, which according to the present invention is a silicon rubber membrane.

The silicon rubber membrane as described above enables the prevention of diffusion of debris and vapor into the microphone and transducer, while at the same time providing the battery compartment 6 with the immediate oxygen influx.

The benefits of the hearing device as proposed by the present invention are the following:

- Sustainable technology for manufacturing of metal-air batteries for extended wear hearing aids,
- Improved reliability of extended wear hearing aids means less frequent replacements which is positive for the subscription business model of such hearing devices
- Improvement of safety because a common microphone/battery barrier would also prevent the leakage of any substance out of the battery cathode
- Simpler manufacturing as the narrow-spec GDB as used today can be avoided
- Could potentially also be applied to standard hearing devices, turning a standard battery into a chocked battery.

The invention claimed is:

1. A hearing device, comprising:
a metal-air battery;
a battery vent associated with the metal-air battery;
a microphone;
a sound inlet associated with the microphone; and
a gas diffusion membrane formed from an oxygen permeable polymer located lateral of and spaced apart from the battery vent and the sound inlet such that a volume is defined between the membrane, at one end of the volume, and the battery vent and sound inlet, at the other end of the volume.

2. The hearing device claimed in claim 1, wherein
the gas diffusion membrane separates the battery vent and the sound inlet from the surroundings of the hearing device.

3. The hearing device claimed in claim 1, wherein
the gas diffusion membrane comprises an elastic oxygen permeable polymer membrane.

4. The hearing device claimed in claim 3, wherein
the elastic oxygen permeable polymer membrane comprises a silicone rubber membrane.

5. The hearing device claimed in claim 4, wherein the silicone rubber membrane defines a thickness selected from the group consisting of less than 60 μm, less than 40 μm, and less than 20 μm.

6. The hearing device claimed in claim 4, wherein the silicone rubber comprises dimethyl silicone rubber.

7. The hearing device claimed in claim 1, wherein the gas diffusion membrane defines a thickness selected from the group consisting of less than 60 μm, less than 40 μm, and less than 20 μm.

8. The hearing device claimed in claim 7, wherein the gas diffusion membrane is either a compression molded silicon rubber membrane or an injection molded silicon rubber membrane.

9. The hearing device claimed in claim 1, wherein the gas diffusion membrane defines a diameter of 2-5 mm.

10. The hearing device claimed in claim 1, wherein the gas diffusion membrane defines an elliptic shape.

11. The hearing device claimed in claim 1, further comprising:

a tube that extends laterally of the gas diffusion membrane.

12. The hearing device claimed in claim 1, wherein the hearing device comprises an in-the-ear hearing device.

* * * * *